United States Patent [19]

Helms

[11] 4,442,971

[45] Apr. 17, 1984

[54] PEELABLE, SEALABLE CLOSURE ARRANGEMENT

[75] Inventor: Charles R. Helms, Malvern, Pa.

[73] Assignee: Container Corporation of America, Chicago, Ill.

[21] Appl. No.: 416,949

[22] Filed: Sep. 13, 1982

[51] Int. Cl.[3] ..... B65D 5/64

[52] U.S. Cl. ..... 229/43; 220/306; 229/5.8

[58] Field of Search ..... 229/43, 5.8; 220/306, 220/307, 359

[56] References Cited

U.S. PATENT DOCUMENTS

| | | | |
|---|---|---|---|
| 2,859,786 | 11/1958 | Tupper | 220/306 |
| 2,956,721 | 10/1960 | Bennett | 229/43 |
| 3,052,368 | 9/1962 | Atkins | 220/306 |
| 3,155,233 | 11/1964 | Tupper | 220/306 |
| 3,397,814 | 8/1968 | Zackheim | 220/306 |
| 3,892,351 | 7/1975 | Johnson | 229/43 |
| 4,044,941 | 8/1977 | Knudsen | 220/306 |
| 4,141,463 | 2/1979 | Smith | 229/43 |
| 4,238,047 | 12/1980 | Helms | 229/43 |
| 4,289,252 | 9/1981 | Helms | 220/306 |

*Primary Examiner*—Herbert F. Ross

*Attorney, Agent, or Firm*—Richard W. Carpenter; Davis Chin

[57] ABSTRACT

A peelable, sealable closure arrangement for a container body and lid adapted to insure integrity of seal when internal pressure increases within the container. The closure arrangement includes a container lid rim having a radially inward projecting lip with a sharp pointed peripheral edge capable of biting into the container body rim to insure a hermetic seal at all times between a sealable membrane and the container rim.

5 Claims, 5 Drawing Figures

PEELABLE, SEALABLE CLOSURE ARRANGEMENT

BACKGROUND OF THE INVENTION

1. Field of the Invention

This invention relates generally to closure arrangements, and more particularly it relates to a closure arrangment including a composite lid formed of molded plastic and paperboard and a container body having a rim which may be hermetically sealed to the lid.

2. Description of the Prior Art

The prior art appears to be best exemplified in the following U.S. Patents which were developed in a search directed to the subject matter of this application:

U.S. Pat. Nos. 2,721,686; 2,801,039; 2,893,456; 2,894,381; 3,397,814; 3,642,167; 3,892,351; 3,942,679; 4,044,941; 4,141,463.

However, none of the prior art listed above disclosed a peelable, sealable closure arrangement for a container body and lid adapted to insure integrity of seal when internal pressure increases within the container like that of the present invention.

SUMMARY OF THE INVENTION

It is an object of the invention to provide, in a closure of the type described, means for insuring that the integrity of the seal between the container and lid will be maintained even though internal pressure generated within the container may cause the center of the lid to deflect out of its normal horizontal plane.

A more specific object of the invention is the provision of a container lid rim having a radially inward projecting lip with a sharp pointed peripheral edge capable of biting into the container body rim to insure a hermetic seal at all times between the sealable membrane and container rim.

These and other objects of the invention will be apparent from an examination of the following description and drawings.

It will be understood that, for purposes of clarity, certain elements may have been intentionally omitted from certain views where they are believed to be illustrated to better advantage in other views.

DETAILED DESCRIPTION OF THE PREFERRED EMBODIMENTS

Figure 1:
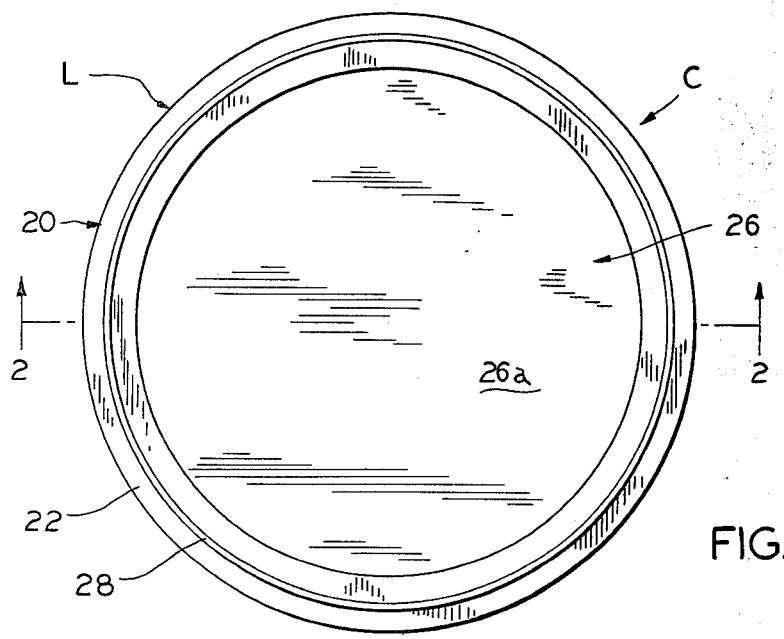
FIG. 1 is a top plan view of a container body and lid havng a closure arrangement embodying features of the invention.
Figure 2:
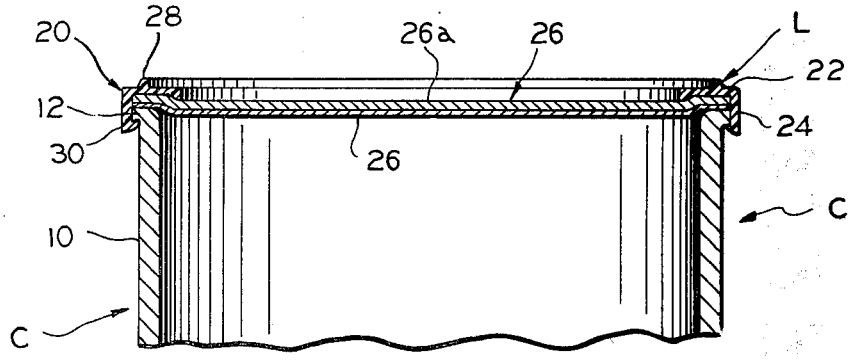
FIG. 2 is a fragmentary, vertical section taken on line 2—2 of FIG. 1.

Referring now to the drawings for a better understanding of the invention, it will be seen that the closure arrangement illustrated in FIGS. 1 and 2 includes a tubular container indicated generally at C, to which is attached a closure member or lid indicated generally at L. Although the container and lid illustrated in the drawings are round in cross section, the configuration could be oval, hexagonal, rectangular or of other shape without departing from the scope of the invention.

Figure 3:
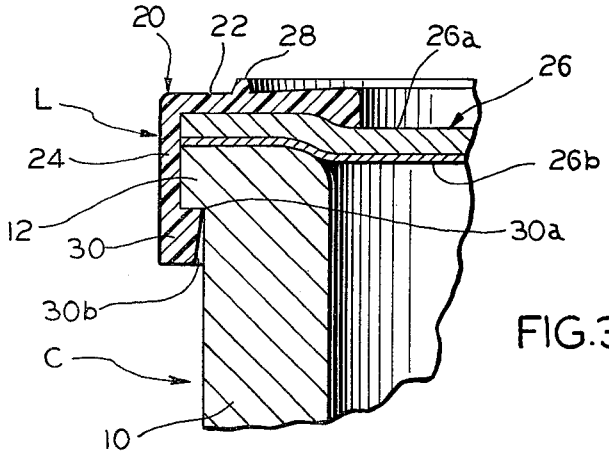
FIG. 3 is an enlarged porition of the structure illustrated in FIG. 2.

In the embodiment illustrated in FIGS. 1 through 3, the container is a one-piece unit formed of molded plastic material having a tubular body wall 10 which is provided at its upper extremity with a circumferential flange or rim 12 projecting radially outwardly from the body wall.

Lid L has a rim 20 with an annular horizontal flange 22 and a vertical flange or skirt 24 depending from the outer periphery of the horizontal flange.

Lid L also includes a central panel 26 which includes a layer of paperboard **26*a* having the underside thereof provided with a coating 26*b* of a material which is suitable for heat sealing with the material of the container rim 12. This is preferably polyethylene but may be of some other composition. The lid L is of the general type described in U.S. Pat. No. 3,397,814. It is a composite lid wherein the central panel 26 is secured at its marginal edge to the underside of rim flange 22** at the same time that the lid, which is of molded plastic material, is being formed.

Lid rim 20 also includes an upwardly projecting annular bead 28 which serves to facilitate the stacking of the lid with similar lids. Formed integrally with and projecting radially inward from the lower extremity of rim skirt 24 is an annular shoulder or lip 30 which presents a sharp pointed upper inner edge **30*a* and a rounded or chamfered lower inner edge 30*b***.

After the container C has been filled and lid L has been snapped over the rim of the container, heat is applied to bond the coating on the underside of the lid center panel to the upper surface of the container rim to effect a hermetic seal therebetween.

As gases are generated within the container and cause an upward pressure to be exerted on the lid, the engagement between the shoulder or lip of the lid rim with the underside of the container rim prevents the seal from being separated or destroyed. In order to intentionally removed the lid from the container, one side of the lid can be grasped and pulled upwardly to peel the lid off of the container rim.

Figure 4:
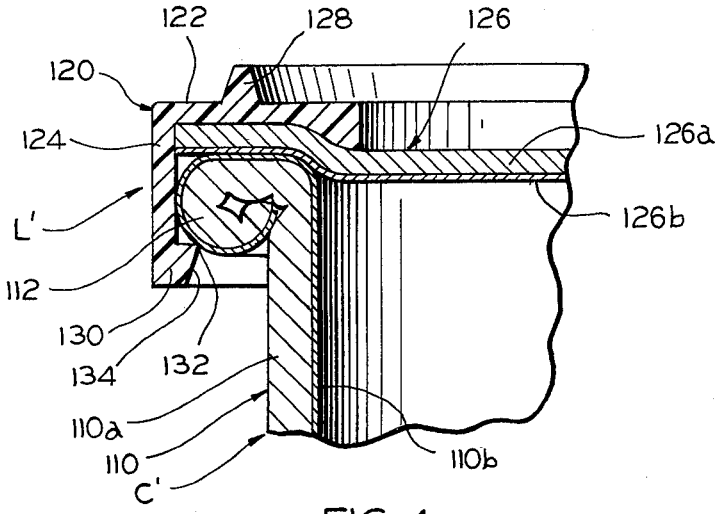
FIG. 4 is a view similar to FIG. 3 but illustrating a modified form of the invention.
Figure 5:
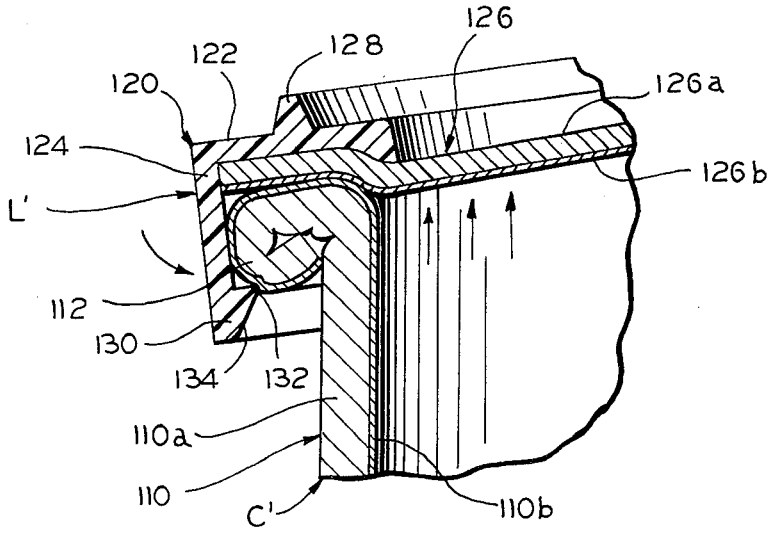
FIG. 5 is a view similar to FIG. 2 but showing the relationship of the container lid to the container body when the former is deflected out of its normal position as a result of internal pressure from gas generated within the latter.

Turning now to FIGS. 4 and 5, it will be seen that a slightly modified form of the invention is shown. In this embodiment the parts corresponding to those of the previous embodiment have been designated with similar numerals. In this embodiment the lid construction is the same as that of the previous embodiment.

The body wall 110 of container C is formed of at least one layer **110*a* of paperboard which is provided with an inner layer or coating 110*b*** of thermoplastic material such as polyethylene.

The upper marginal portion of the body wall 110 is curled outwardly to form a flange or rim 112 for engagement with Lid L.

FIG. 5 illustrates the closure when the center of the lid is deflected out of its normal horizontal plane by internal pressure caused by gases developed within the container. This condition is generally referred to as "doming." Because of the unusual construction of the lid rim shoulder or lip 130, it will be seen that even though the lid is deflected out of position, the edge 132 of the lid rim lip 130 bites or digs tighter into the underside of the container body wall flange 112 to maintain the lid rim in snug engagement with the container rim, and thereby preserve the integrity of the hermetic seal therebetween.

I claim:

1. A peelable, sealable closure arrangement for a container body and lid adapted to insure integrity of seal when internal pressure increases within the container, said arrangement comprising:

(a) a tubular container body, open at the upper end, including:
  (i) a body wall;
  (ii) a peripheral rim extending radially outward from an upper marginal portion of said body wall;

(b) a lid adapted for interlocking and hermetic sealing engagement with said container body;

(c) said lid including a generally flat central panel having:
  (i) a layer of paperboard;
  (ii) a coating on the underside of said paperboard layer, which coating is formed of plastic material which is compatible for heat sealing to an inner surface of said container body rim;

(d) said lid also including a molded plastic rim having:
  (i) a horizontal flange, the underside of which is secured to a marginal area of the upper side of said central paperboard panel;
  (ii) a skirt depending from the outer periphery of said rim;
  (iii) a lip projecting radially inward from a lower extremity of said skirt and defining with portions of said skirt and said central panel an annular channel for receiving the rim of said container body;
  (iv) said lid rim having a downwardly tapered inner portion whose underside is secured to said lid central paperboard panel to maintain an inward deflection of said panel;

(e) said lid rim lip having a sharp pointed inner peripheral edge adapted to bite into said container rim to maintain said lid and container body rims in sealing engagement with each other even when the said lid central paperboard panel is deflected out of its normal horizontal plane by internal gas pressures generated within said container.

2. A closure arrangement according to claim 1, wherein said lid rim and central panel are secured together in a mold as said rim is being formed.

3. A closure arrangement according to claim 1, wherein said container body is formed of molded thermoplastic material.

4. A closure arrangement according to claim 1, wherein said container body includes an outer ply of paperboard and an inner coating of thermoplastic material.

5. A closure arrangement according to claim 1, wherein an upper marginal portion is curled radially outward to form said container body rim.

* * * * *